United States Patent [19]

Wallace

[11] Patent Number: 4,735,361

[45] Date of Patent: Apr. 5, 1988

[54] JET DEFLECTING SPRINKLER HEAD

[76] Inventor: Norman R. Wallace, 742 Hilton Rd., Walnut Creek, Calif. 94595

[21] Appl. No.: 862,055

[22] Filed: May 12, 1986

[51] Int. Cl.[4] ..... B05B 1/26

[52] U.S. Cl. ..... 239/110; 239/382; 239/507

[58] Field of Search ..... 239/500, 502, 503, 505, 239/507–513, 515, 106, 110, 201, 590.3, 122, 380–383

[56] References Cited

U.S. PATENT DOCUMENTS

| | | | |
|---|---|---|---|
| 816,897 | 4/1906 | Bray | 239/510 X |
| 832,097 | 10/1906 | Thomas | 239/512 |
| 1,004,709 | 10/1911 | Sutherland | 239/500 X |
| 1,020,937 | 3/1912 | Warwick | 239/122 |
| 1,837,322 | 12/1931 | Hamilton | 239/201 |
| 1,933,428 | 10/1933 | Harry | 239/515 |
| 1,951,587 | 3/1934 | Tyler | 239/122 X |
| 1,989,013 | 1/1935 | Levine | 239/122 |
| 2,077,725 | 4/1937 | Tyler | 239/122 |
| 2,571,768 | 10/1951 | Schlonau et al. | 239/513 |
| 2,774,631 | 12/1956 | Wahlin | 239/590.3 |
| 2,779,478 | 1/1957 | Wahlin | 239/590.3 |
| 2,905,196 | 9/1959 | Van Wagenen et al. | 239/110 X |
| 4,566,632 | 1/1986 | Sesser | 239/513 X |
| 4,596,362 | 6/1986 | Pralle et al. | 239/505 X |

FOREIGN PATENT DOCUMENTS

| | | | |
|---|---|---|---|
| 120202 | 5/1927 | Switzerland | 239/515 |
| 15099 | of 1902 | United Kingdom | 239/510 |
| 911413 | 11/1962 | United Kingdom | 239/510 |

*Primary Examiner*—Andres Kashnikow
*Assistant Examiner*—Mary Beth O. Jones

[57] ABSTRACT

A fluid dispersing apparatus suitable for use as a sprinkler in water irrigation applications whereby a jet of fluid is reflected from one or more rigid surfaces to preserve fluid particle speed. The reflecting surfaces are shaped to provide a variable but adjustable range of sector coverage in the spray pattern while maintaining range of fluid dispersal coverage. Through substitution of system components, a broad range of fluid dispersing requirements can be met with the same basic substructure. In the absence of fluid jet pressure, the principal jet reflecting assembly settles into a compact, low profile configuration.

15 Claims, 5 Drawing Sheets

JET DEFLECTING SPRINKLER HEAD

BACKGROUND OF THE INVENTION

This invention relates to the free stream dispersal of fluids put into motion by a hydrostatic pressure difference and, more particularly, to the spray of water produced by fixed sprinkler heads for the purpose of irrigation. Sprinkler heads as commonly used consist of a standard body part with female threads for attaching the body part to a riser nipple and and orifice piece which screws into the body part. The orifice piece contains a centered entrance hole as a passageway for water entering under pressure from the riser. The water exits from the orifice piece as a spray whose special distribution is determined by the shape of the exitway. The exitway, as presently manufactured for sprinkler head orifice pieces, is molded or saw cut to cause a desired sector of spray coverage such as "full circle" or "quarter circle." Means are provided in the orifice piece to balance a sprinkler circuit containing several sprinkler heads. The means consist of a screw adjustment of the volume of water delivered from each head. By reducing the volume of water discharged from upstream heads on a circuit, overpressure is preserved for the volume discharge of downstream heads on the same circuit. However, the range of adjustment is limited, primarily because reduction of the volume discharge through an orifice causes the velocity to decrease. There becomes too little momentum in the water flow to interact with the orifice piece exitway, and the desired spray configuration deteriorates. At still lower volume flowrate, there is no spray at all and the water just dribbles off the sprinkler head. These circumstances limit the number of sprinkler heads that can be put on one circuit. The number of heads allowable is determined by the available hydrostatic pressure, the length of piping on the circuit, the pipe diameter and the practical volume throughput of each sprinkler head.

In the present art, sprays are frequently created from a jet by intercepting the jet with a reflecting surface. A case in point is the spray bottle, used, for example, to spray insecticides. Although this invention will be seen to employ a deflected jet, the purpose of this invention is to tailor the spray to specific fluid flow and geometrical requirements while the spray bottle cited above derives from a different objective. The deflector on a spray bottle is incidental to the spray bottle operation. The jet in a spray bottle is required for aspirating the bottle contents, and the spray deflector may be attached at the option of the user.

SUMMARY OF THE INVENTION

The present invention not only overcomes the disadvantages described above for the present art in sprinkler heads, but it also provides a high level of versatility and adaptability of the spatial coverage of the spray. The sprinkler head consists of a straight orifice fashioned to produce a clean, high velocity jet of water which is caused to impact a rigid, usually convex surface. The velocity of the jet and its distance of travel from the orifice exit to the jet impacted surface can be so chosen that the jet will not break up into separated droplets before the impact occurs. Then, each streamline of the jet will reflect specularly from the rigid surface; that is, the incoming streamline, the outgoing (reflected) streamline and the normal to the surface are coplanar. This circumstance has two desirable features. First, the speed of the jet is not diminished by the impact so the range of the resulting spray is not reduced because of the impact. The vector quantities, jet velocity and the corresponding momentum of the jet, change because of the change in direction. But the magnitudes of these quantities remain essentially unchanged. Reflection of the jet requires a reactive force from the reflecting surface. This is beneficial in the concept of the invention, for it holds the reflector in position during sprinkler operation as will be seen.

The second beneficial feature is that the sector coverage of the sprinkler pattern can be controlled by the angle of incidence of the jet on the impacted surface. For example, if the jet is directed along the central axis of a sphere, the jet centerline will be coincident with a normal to the surface of the sphere. The resulting spray pattern will be a full circle. The centerline of the impinging jet is a normal to the plane of this circle. A second reflecting surface will be useful in full-circle operation to deflect the spray upwards as will be discussed later.

When the jet centerline makes some angle with respect to the sphere's normal at the point of contact, the spray pattern will be some sector of a circle. Thus, a continuous range of spray patterns can be obtained with the same jet and the same spherical reflector by continuously changing the angle of incidence of the jet impingement to the spherical surface. From full circle coverage when the jet is normal to the sphere to a narrow angle spray when the jet strikes at glancing incidence can be obtained continuously by adjustment of the sphere position relative to the jet.

Although the spherical jet reflector may have general utility, other surface shapes can be used for special purposes. For example, if a narrow spray pattern is desired, a cylindrical reflector can be used with the cylinder's axis at right angles to the jet centerline. Increasing the angle of incidence between the jet and the normal to the cylinder's surface increases the angle of the plane of the spray pattern relative to the horizontal.

Other surface shapes than spherical and cylindrical for the jet reflector could well be more efficient in controlling the elevation angle of the spray pattern for increasing angle of incidence of the jet. Such shapes can be determined by theoretical means or by trial and error.

The invention consists of an orifice to discharge a fluid jet from a reservoir such as a sprinkler circuit riser onto one or more surfaces whose shapes and positions dictate the geometry of the spray in both area of coverage and angle (or distance) of throw. The reflecting surfaces and the jet orifice are assembled into an adjustable and interchangeable structure such that any realizable combination of flowrate and spray coverage can be conveniently obtained. Many sprinkler heads of this invention can be accommodated on one circuit by reducing the flowrate in every head using a small diameter orifice in each head and simply watering longer to achieve the desired level of ground saturation.

Existing irrigation circuits can be modified to meet changing or specific needs by retrofitting the orifice and reflector surfaces.

Other objects and advantages of this invention will become apparent as the following specification progresses, reference being had to the accompanying drawings for illustration of the invention.

DETAILED DESCRIPTION OF THE PREFERRED EMBODIMENTS

Figure 1:
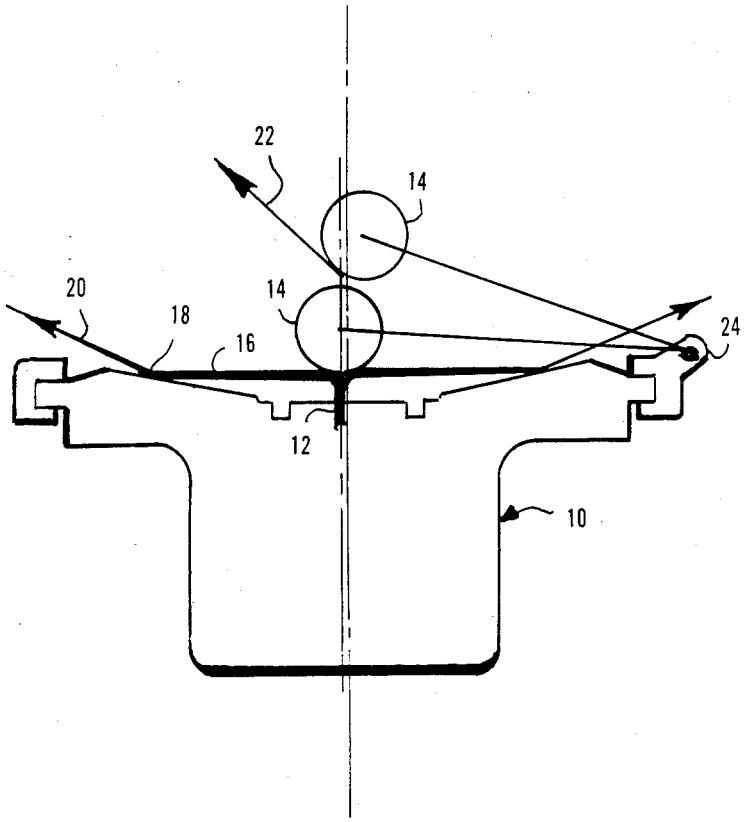
FIG. 1 is a conceptualized cross-section of the spray pattern of a jet reflecting from a spherical deflector in the full circle distribution pattern (per discussion above) and reflecting from some intermediate position of the sphere as the angle of incidence of the jet is changed.

The fluid dispersing apparatus of the present invention is broadly denoted by the numeral 10 in the schematic of the embodiment shown in FIG. 1. A jet of fluid 12 is shown to emerge and impinge on a reflecting surface 14 in the direction of the normal to that surface. There emerges a reflected spray of fluid 16 from the point of contact with the reflecting surface 14. This spray makes a second reflection at surface 18 to produce a conical surface of spray 20 whose elevation angle is suitable for dispersing the fluid over the desired area of coverage.

For illustrative purposes, reflecting surface 14 is shown at a higher elevation from fluid jet 12 and rotated clockwise about hinge point 24. The consequential increase in angle of incidence, as measured by the angle between the incident jet 12 and the normal to the reflecting surface 14, produces a more elevated spray pattern 22. A second spray reflection from surface 18 no longer occurs.

Figure 2A:
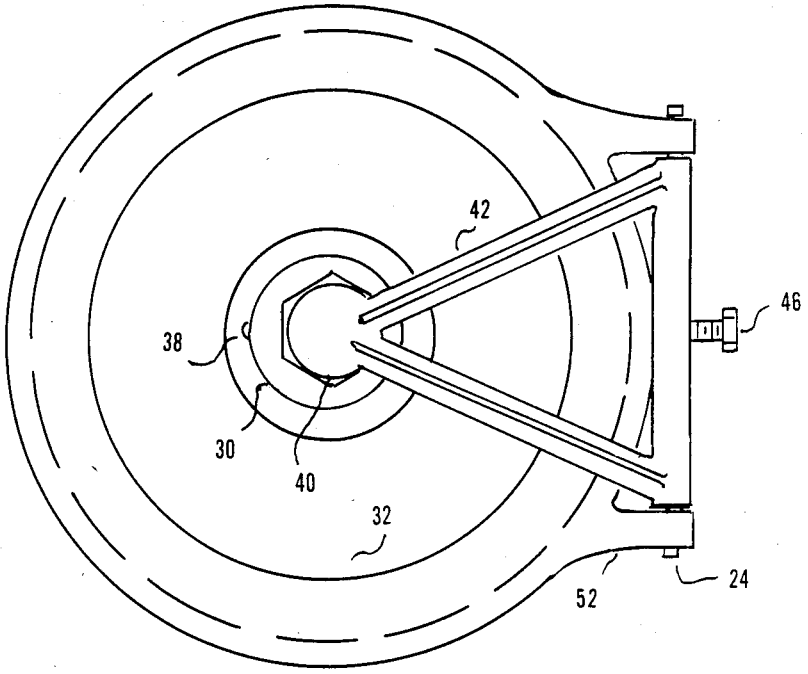
FIGS. 2*a* and 2*b* are a plan view and cross section, respectively, of elements of the body part of the concept adapted to a sprinkler head for use in a garden application of the invention.
Figure 2B:
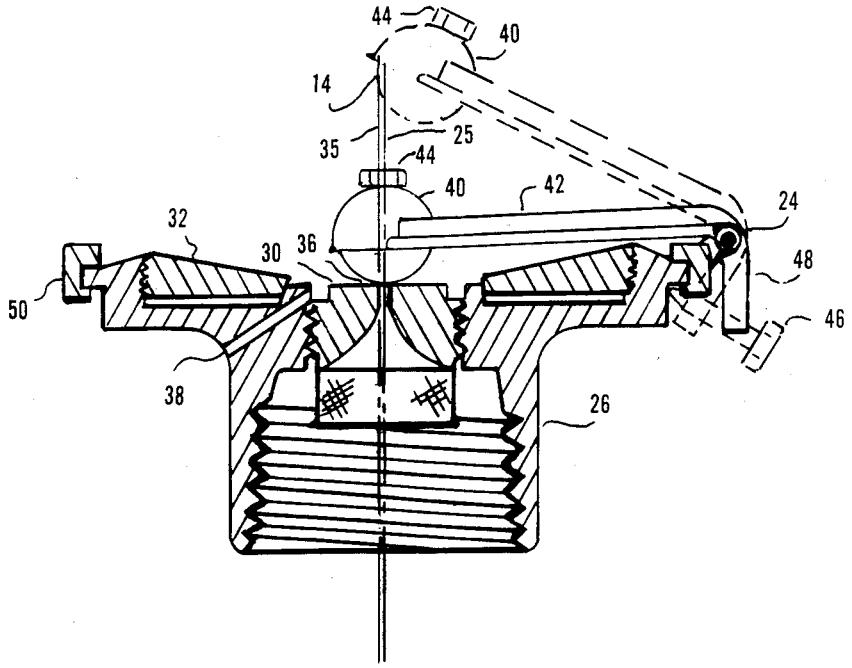

FIG. 2*b* shows mechanical details of the embodiment in cross section through body part 26, and FIG. 2*a* shows the plan view.

Body part 26 has internal threads 28 for attachment to a riser pipe. Body part 26 is also threaded to receive orifice insert 30 and secondary reflector piece 32.

Orifice insert 30 is shown to have attached a filter screen 34 for easy removal and cleaning. This is optional to the preferred embodiment and may not be required for large orifices in clean fluid service.

Orifice 36 is shown to have a tapering entranceway to establish a vena contracta of 1.0. Sharp-edged orifices or other configurations are equally acceptable so long as the emergent jet is well-defined. The axis 35 of orifice 36 is shown to be off-center from the axis 25 of body part 26. The reason for this will be forthcoming as this specification proceeds.

Since the secondary reflector 32 is concave, liquid spray fluid could collect over the orifice insert 30 and drown the jet 12 emitting from orifice 36. To eliminate this possibility, one or more drain passages 38 can be provided in body part 26.

Reflecting surface 14 is shown in the rest position (no fluid flow) in solid lines in FIG. 2. Reflector 14 is partially encapsulated by retainer segment 40 which is itself attached to support lever arm 42. Retainer screw 44 holds the reflector 14 in position and allows the attitude of the reflector 14 to be adjusted with respect to jet 12 by rotating retainer screw 44.

Support lever arm 42 holds the reflector 14 in the desired position relative to impingement of jet 12. Adjustment of the desired position is made through adjustment screw 46 shown in the most elevated position of reflector 14. In this position, jet 12 makes only glancing incidence with reflector 14. Intermediate operating positions of reflector 14 are obtained by advancing adjustment screw 46 inwards so as to contact body part 26 earlier as fluid pressure from jet 12 lifts reflector 14.

Adjustment screw 46 is threaded into adjustment arm 48. This is just one of several means for controlling the lift and reaction of reflector 14 against the force of jet 12.

Figure 3:
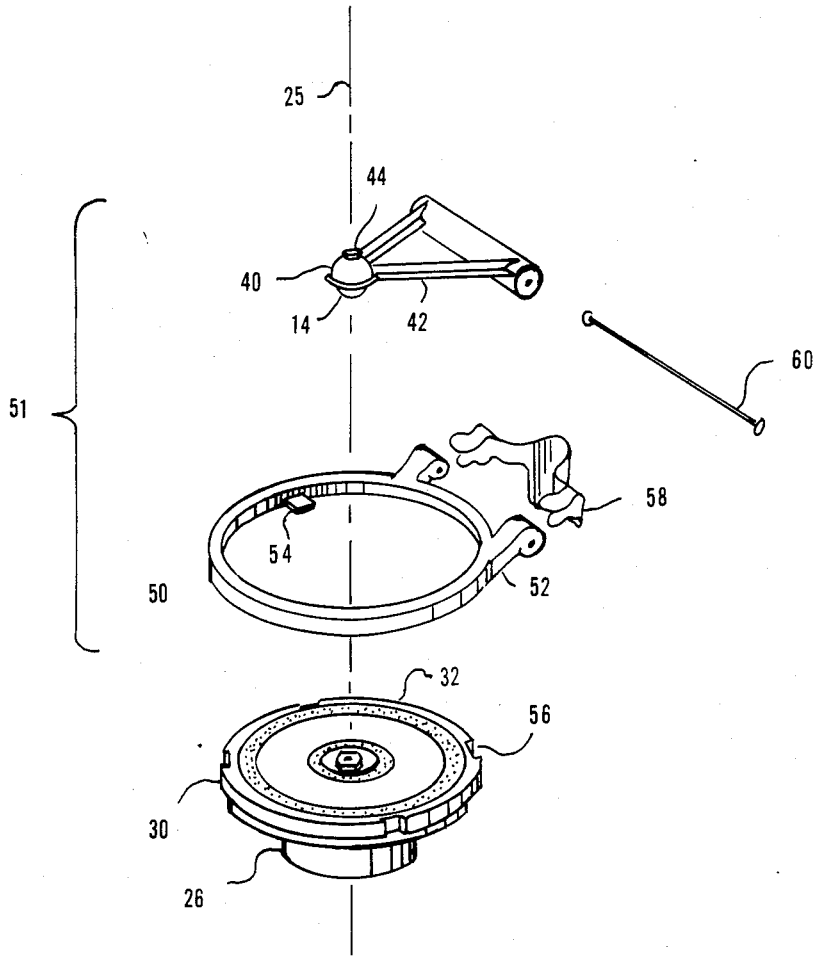
FIG. 3 is an exploded view of FIG. 2 showing elements of the preferred embodiment and their assembly.

Ring 50 is attached to lever arm 42 and adjustment arm 48 through hinge supports 52. Ring 50 is held down against body part 26 by tabs 54 as shown in FIG. 3, by set screws or by other means. Ring 50 is free to rotate about the axis of symmetry of body part 26 until the desired adjustment is achieved; ring 50 is then locked down as required to maintain position during spray operation.

The assembly of the apparatus is clarified in the exploded view of FIG. 3. Body part 26 is shown with orifice insert 30 and secondary reflector 32 screwed into place. Ring 50 with tabs 54 are shown to insert into keyways 56. Lever arm 42 and adjustment arm 48 are integral in one component to fit between hinge supports 52.

Shaft 60 connects this assembly to ring 50.

Soil deflector 58 snaps onto hinge supports 52 for application to a lawn sprinkler head which is below grade. This prevents soil from intruding and interfering with the motion of adjustment screw 46.

Arms 42 and 48 together with reflector 14 mounted into retainer segment 40 and attached to ring 50 through shaft 60 can be provided as one integrated unit for mounting on body part 26. Rotation of this integrated unit around body part axis 25 can produce a symmetric spray off reflector 14 if the axis 35 of orifice 36 is made parallel but not collinear with axis 25. Moreover, nonsymmetric spray off reflector 14 can be made stable and free of hinge chatter by having axes 25 and 35 noncoplanar with the bisector plane of the hinge points 24.

Figure 4:
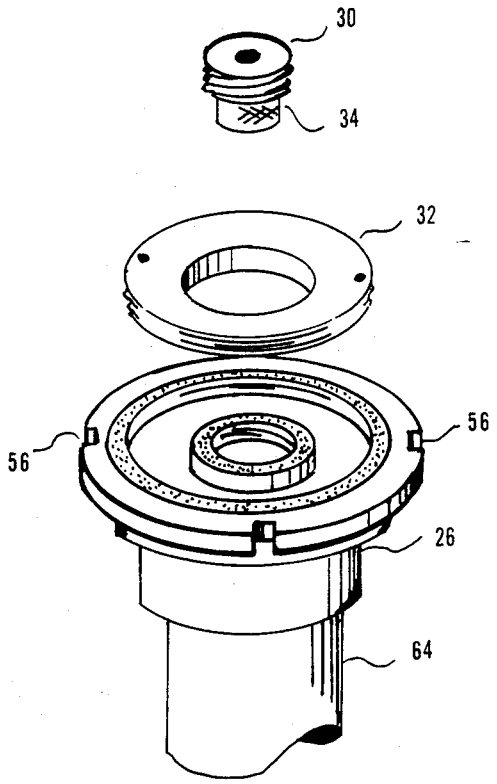
FIG. 4 is an exploded view of the body of a sprinkler head and its interchangeable parts.

FIG. 4 is an exploded view of the body part 26 and its inserts, filter screen 34 attached to orifice insert 30 and reflector piece 32. A riser pipe section 64 is also shown to be screwed into body part 26. The same, standardized body part 26 can accept in-situ unlimited variations in flowrate, sector of spray coverage, elevation angle of the spray dispersal cone and distribution of spray intensity as a function of sector angle in the spray cone. In all variations, maximum fluid particle speed is maintained in the spray to maximize the range of spray dispersal. These variations are achieved by inserting into the body part 26 the desired combination of orifice insert 30, reflector piece 32 and the reflector subassembly 51 generally consisting of reflector 14, retainer segment 40, lever arm 42 and ring 50.

Figure 5A:
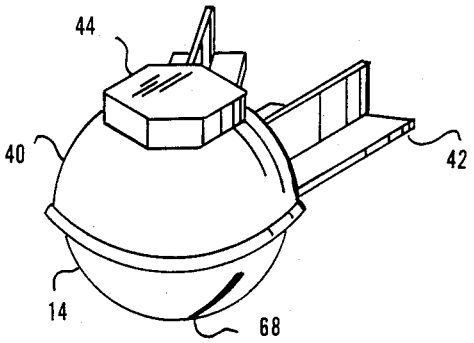
FIGS. 5*a* and 5*b* show details of the reflector assembly and means whereby increased versatility of the concept can be achieved.
Figure 5B:
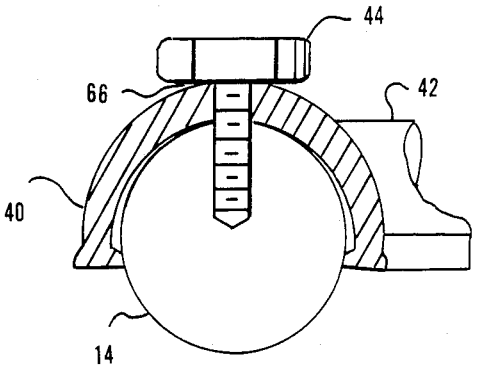

FIG. 5*a* shows an enlarged view of reflector 14 and retainer segment 40. FIG. 5*b* is a side view and cross section through retainer segment 40. Retainer screw 44 holds reflector 14 firmly in place and is secured by lock washer 66. Reflector 14 is rotatable for adjustment by rotating retainer screw 44. A cut or plurality of cuts 68 can be made in the surface of reflector 14 to locally concentrate the spray intensity at the point of jet 12 impingement on reflector 14. This more concentrated stream of fluid can be directed towards a specific target beyond the range of the distributed spray pattern by rotating reflector 14 via rotation of retainer screw 44.

The following example illustrates the selection and sizing of components to meet a particular sprinkler application.

Suppose it is desired to select components of the invention to spray the low flowrate of ¼ GPM under conditions of low available water pressure at the sprinkler head of 15 psi. Full circle spray coverage is intended with an elevation angle of the spray cone to be 20 degrees. From FIG. 1 it is seen that the departure spray 16 of jet 12 from reflector 14 is at right angles to jet 12 for the case of full circle spray coverage. Spray 16 intercepts secondary reflector 32 at impact points 18. If the secondary reflection can be made specular, the angle of spray departure would be equal to the angle of incidence. For departure spray 20 to have a 20 degree angle of elevation from the horizontal, the secondary reflector 32 should have a conical surface whose gradient angle is 10 degrees.

The velocity of the jet 12 is determined from the hydrostatic pressure by $$q = \sqrt{2gh}$$

$q$ = velocity in ft/sec in the jet
$g$ = acceleration of gravity
= 32.2 ft/sec$^2$
$h$ = hydrostatic head in feet of water For fresh water, 1 psi=2.3 ft of water. For an available 15 psi, the jet velocity is 47.1 ft/sec=1436 cm/sec.

The selected flowrate of ¼ GPM is equivalent to 15.8 cubic centimeters per sec. This is related to the orifice diameter and jet velocity by $$Q=Aq$$

Q=volume flowrate
A=area of jet
q=jet velocity

Knowing Q and q, A is found to be 0.011 square centimeters, so the diameter of the jet should be 1.2 millimeters. When the vena contracta is made to be 1.0 as in the embodiment of the invention discussed herein, the orifice diameter is the same as the jet diameter. Assume the reflector 14 is a steel sphere in this example with a diameter of ¼ inch. The weight of this sphere is calculated to be approximately 0.0023 pounds. The force imposed by the jet against this sphere must be at least this amount in order to lift and hold the sphere in position during operation of the spray.

The force imparted by the jet to the sphere for the sample case of full circle coverage is given by $$F=\rho A q^2$$

F=reaction force of the jet
$\rho$=mass density of the fluid
A=area of jet
q=jet velocity $$F = 1.0 \text{ grams/cc} \times 0.011 \text{ cm}^2 \times (1436 \text{ cm/sec})^2$$
$$= 22640 \text{ dynes}$$
$$= .0509 \text{ pounds}$$

Comparing this with the weight of the sphere reflector, it can be seen that the force of the jet is about 43 times the weight of the sphere.

This sample calculation shows that the invention is eminently practical as a fluid spray device even at low volume flowrates and hydrostatic pressures. With the versatility provided by the interchangeability of components of the invention, virtually any sprinkler function now existing can be done more efficiently and more expeditiously than with heretofore available means.

What is claimed is:

1. A fluid delivery device comprising:

a tubular body having a central axis and a normally upper surface and provided with a fluid outlet port for passing a jet of fluid under pressure directed through the body;

a reflector;

means mounting the reflector in alignment with the outlet port for movement toward and away from the port, the reflector having a curved outer surface for deflecting the jet;

means coupled with the reflector for limiting the movement of the reflector away from the outlet port under the influence of the impact force of the jet on the reflector, the central axis of said body part being generally parallel to but not collinear with the axis of said jet.

2. A fluid delivery device as set forth in claim 1, wherein is included means coupled with said reflector mounting means for rotating said mounting means about the outlet port.

3. A fluid delivery device as set forth in claim 1, wherein said reflector mounting means includes a lever arm, and means coupled with the body for pivotally mounting the lever arm at one end thereof for rotation about a generally horizontal axis, said reflector being mounted on the opposite end of the lever arm.

4. A fluid delivery device as set forth in claim 1, wherein the reflector has score lines on the outer surface thereof for use in deflecting the jet from said outlet port in predetermined directions.

5. A fluid delivery device as set forth in claim 1, wherein is included means on the body for defining a secondary reflector surface therefor.

6. Fluid delivery apparatus comprising:

a body part having a generally vertical central axis and adapted to be coupled to a source of fluid and having means for forming a jet and a subassembly coupled to said body part, said subassembly including a reflector for intercepting said jet issuing from said jet forming means of said body part and means coupled to said reflector for mounting the reflector for rotation about the generally vertical central axis of said body part and for movement of said reflector towards and away from said body part about a generally horizontal axis, and means for adjusting the distance through which said reflector can move away from said body part due to the impact force produced by said jet, whereby the sector angle of the spray pattern issuing from said reflector can be caused to change as said distance changes, wherein the central axis of said body part is generally parallel but not collinear with the axis of said jet.

7. Apparatus according to claim 6 in which said means for forming said jet includes an insert piece having an orifice and insertable into and removable from said body part.

8. Apparatus according to claim 6 in which said reflector has any curved configuration for deflecting said jet into a spray pattern for further reflection from a secondary reflector attached to said body part or for dispersal with no further spray reflecting contacts.

9. The apparatus of claim 6 wherein is included a secondary reflector removably mounted on said body part.

10. Apparatus according to claim 6 in which said subassembly is attachable to said body part, is rotated for adjustment of said contact point of said jet on said reflector, and is locked in place to preserve said adjustment.

11. Apparatus according to claim 6 wherein is included means for restraining said reflector in position against the impact forces of said jet, said restraining means including an adjustment arm and a lever arm structure integral with the adjustment arm and having an adjustment screw which contacts said body part to limit movement of said reflector when the reflector is in a desired operative position.

12. Apparatus according to claim 11 wherein is included a soil deflector attachable to said subassembly to prevent extraneous materials from clogging the action of said adjustment screw.

13. Apparatus according to claim 6 wherein one or more drain passages are contained in said body part.

14. The combination as set forth in claim 6 wherein is provided said reflector is scored so that the interaction of said jet with said reflector will result in a predetermined spray pattern.

15. Apparatus according to claim 6 wherein said reflector mounting means includes a lever arm structure and a reflector retainer segment on said lever arm structure, said reflector being carried by and rotatable relative to said retainer segment and said lever arm structure, whereby the reflector can direct the spray pattern of the jet in a desired direction and with a desired sector angle in said spray pattern.

* * * * *